United States Patent [19]

Smith

[11] 4,029,030

[45] June 14, 1977

[54] PATTERNED CUT PILE TUFTING MACHINE

[75] Inventor: Randel P. Smith, Chattanooga, Tenn.

[73] Assignee: The Singer Company, New York, N.Y.

[22] Filed: May 17, 1971

[21] Appl. No.: 144,038

[52] U.S. Cl. ..... 112/79 A

[51] Int. Cl.[2] ..... D05C 15/34

[58] Field of Search ..... 112/79 R, 79 A, 80, 112/78, 266, 410, 221

[56] References Cited

UNITED STATES PATENTS

| | | | |
|---|---|---|---|
| 2,112,512 | 3/1938 | Windham et al. | 112/79 R |
| 2,589,340 | 3/1952 | Chambers | 112/79 R |
| 2,876,441 | 3/1959 | Boyles | 112/79 A |
| 2,990,792 | 7/1961 | Nowicki et al. | 112/79 A |
| 3,025,807 | 3/1962 | Gebert | 112/79 A |
| 3,084,645 | 4/1963 | Card | 112/79 R |
| 3,249,078 | 5/1966 | Nowicki | 112/79 R |
| 3,595,184 | 7/1971 | Watkins | 112/79 R |

*Primary Examiner*—H. Hampton Hunter
*Attorney, Agent, or Firm*—Edward L. Bell; Robert E. Smith; Julian Falk

[57] ABSTRACT

This disclosure relates to a method and apparatus for forming patterned cut pile tufted fabrics and, in particular, colored patterned tufted pile fabrics. The patterns are essentially produced by selectively backrobbing one leg of a cut loop thereby producing a cut loop having one relatively long leg and one relatively short leg. By selectively backrobbing one leg of a cut loop of one color yarn and by refraining from backrobbing a leg of a cut loop of at least a second color, the second color will become predominant in the pattern by virtue of having twice as many long legs of that color making up the surface of the cut pile tufted fabric. The disclosure also encompasses a method and apparatus for producing relatively long nap cut pile tufted fabrics having controlled J-cut loops.

2 Claims, 7 Drawing Figures

INVENTOR.
Randel P. Smith

BY Julian Falk

ATTORNEY

WITNESS:
Marvin Ketterley

INVENTOR.
Randel P. Smith

BY

ATTORNEY

PATTERNED CUT PILE TUFTING MACHINE

GENERAL DESCRIPTION OF INVENTION

This invention relates to tufting machines and, in particular, to cut pile tufting machines including apparatus and methods of forming cut pile fabrics. The invention has for one purpose the production of relatively long nap cut pile fabrics sometimes called shag fabrics which, as known in the art, may require a substantial amount of yarn to produce the pile surface. Through the apparatus and method of the present invention, long nap fabrics can be produced which have substantially the same appearance as prior long nap fabrics but which, however, utilize a substantially lesser amount of yarn. The apparatus of the invention is capable of producing in a controlled manner cut pile loops which have one leg substantially longer than the other or, in other words, have a pronounced J-cut which, in the finished product, result in substantially the same overall appearance of similar fabrics lacking the pronounced J-cut. The apparatus of the invention and the method thereof provide a means for producing a controlled J-cut pile loop for accomplishing this purpose.

Another purpose of the invention is to produce patterned cut pile fabrics, in particular color pattern tufted cut pile fabrics. While utilizing the principle described above and by threading individual needles with different color yarns, the apparatus and method of the invention have the capability of producing a color patterned cut pile tufted fabric by making some cut pile loops of one color with a J-cut construction and others of another color without the J-cut construction. This results in cut pile loops, some of which have two relatively long legs of one color while others have only one relatively long leg of another color. By virtue of the fact that there will be twice as many long cut pile loop legs of one color than of another color, the color produced by the cut pile loops having no J-cut will be more pronounced than the other color produced by the J-cut loops. Additional means may be provided for initiating relative lateral shifting motion between the needles, the loopers, and the knives, and the base fabric so that the predominant colors can be shifted in the pattern and therefore enable the production of a wide range of color designs in the fabric.

Accordingly, it is one object of the invention to provide a novel and improved cut pile tufting machine.

It is another object of the invention to provide a novel and improved apparatus and a method of producing fabrics in a cut pile tufting machine.

It is still another object of the invention to provide a novel and improved apparatus and method for producing patterned cut pile fabrics.

It is a further object of the invention to provide a novel and improved apparatus and method for producing color patterned tufted pile fabrics.

Other objects and advantages of the invention will be best understood by reading the following detailed description with the accompanying drawings.

DETAILED DESCRIPTION OF INVENTION

Figure 1:
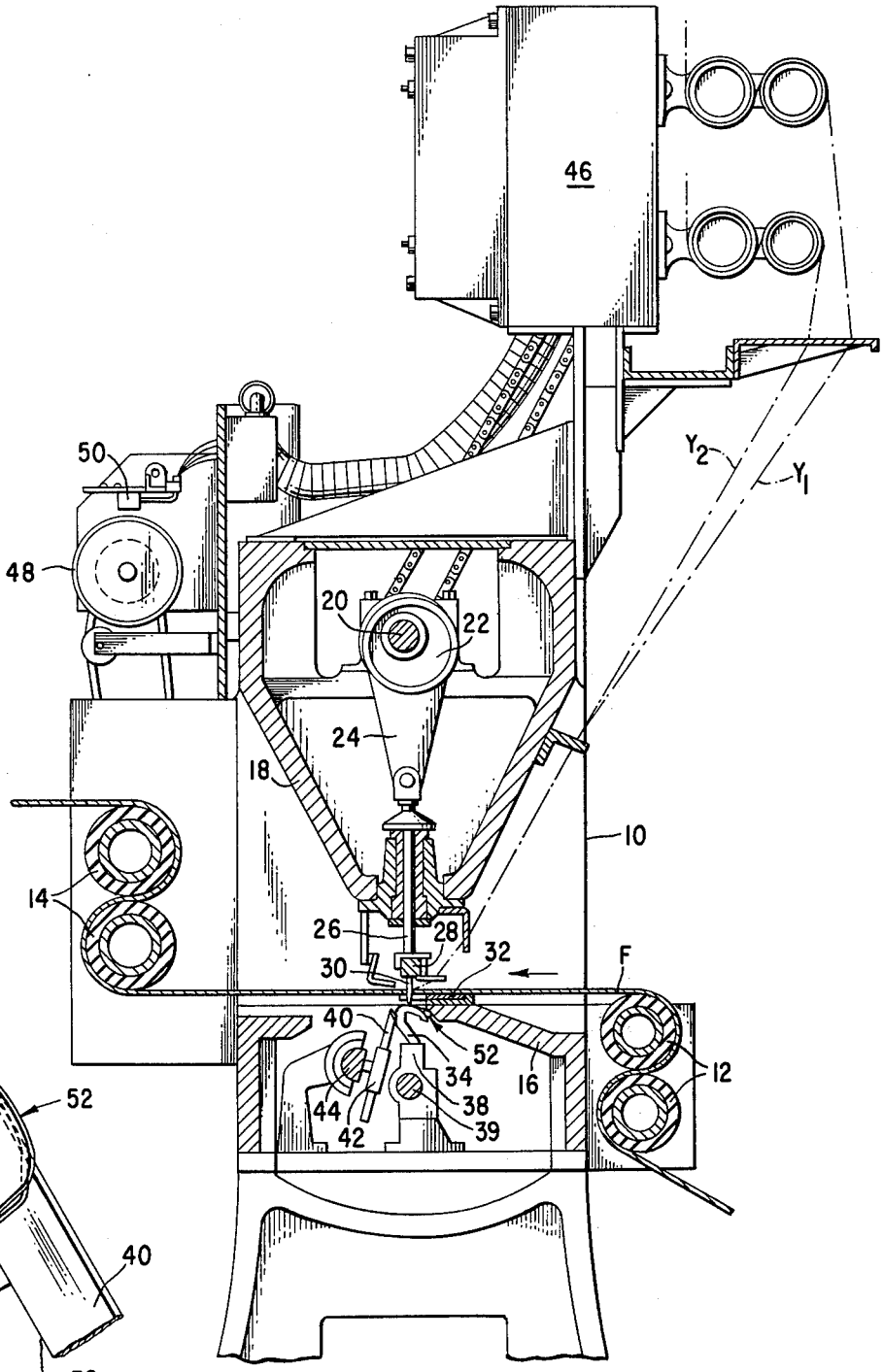
FIG. 1 is an axial, sectional view of a tufting machine embodying the apparatus of the invention.

Referring to the drawings, in particular FIG. 1, a tufting machine is illustrated therein in sectional view, as including a machine frame 10 through which a fabric F is fed by means of feed rolls 12 and 14 across the machine bedplate 16. A machine head portion 18 is provided and supports a needle mechanism which includes a reciprocating needle mechanism generally comprising a main shaft 20 which is driven by suitable means upon which is drivingly supported an eccentric mechanism 22, a connecting rod 24, a push rod 26, and a needle bar 28 to which needles 30 are supported. A needle plate 32 is supported on the bed plate 16 to support the base fabric F and which is provided with openings therein through which the needles 30 reciprocate upon passing through said base fabric as it advances across the machine.

Supported below the bed plate 16 is a plurality of loopers 34 each being supported in a slot 36 in a looper block 38 and disposed for operable working relationship with an associated needle 30. The looper block 38 is a part of, or is supported by, a looper shaft 39 for oscillating or rocking motion and which shaft 39 is operably driven by suitable gearing or driving means connected with the main drive of the tufting machine in a known manner. Operably associated with the looper 34 is a knife 40 which is supported in a knife block 42 carried by a rock shaft 44 which, in turn, is suitably driven by the driving mechanism of the turfing machine, also in a known manner, for oscillating the knife with respect to the looper 34. The knife 40 is provided with a cutting edge which cooperates with an edge or surface on one side of the looper 34 for cutting loops of yarn seized by the looper 34 as is known in the art.

A yarn feed mechanism is also provided for positively and selectively feeding lengths of yarn to the needles. The yarn feed mechanism generally includes a yarn feed pattern attachment 46 through which yarns $Y_1$ and $Y_2$ are threaded as illustrated in FIG. 1. As will be apparent, there may be as many yarns threaded through the pattern attachment 46 as there are needles 30 and, in a standard tufting machine, may include as many as 1500 or more yarn ends. The pattern attachment 46 is controlled by a pattern mechanism generally comprising a transparent drum 48 which is illuminated from the interior and carries on its surface a pattern having opaque and translucent portions. The pattern on the drum 48, which is driven in timed relation with the tufting mechanism of the tufting machine, is read by photocells 50 which, in turn, transmit signals through suitable electric mechanism as illustrated in FIG. 1 to the pattern attachment 46 for selectively feeding the yarn in accordance with the indications on the pattern. Such pattern attachments are known in the art and reference may be made to U.S. Pat. No. 2,966,866 for a more complete description of this type pattern attachment. Of course, it should be understood that the invention is not restricted to the pattern attachment illustrated and other pattern attachments, which can selectively and positively feed controlled lengths of the yarn, may be used. For example, a pattern attachment such as that shown in the U.S. Pat. No. 2,935,037 could also be used with the apparatus of the invention as will be best understood hereinafter.

Figure 2:
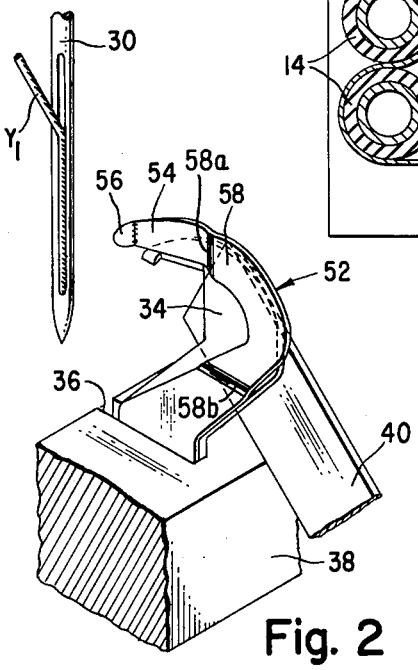
FIG. 2 is an enlarged, perspective view of a portion of the tufting mechanism of the invention.
Figure 3A:
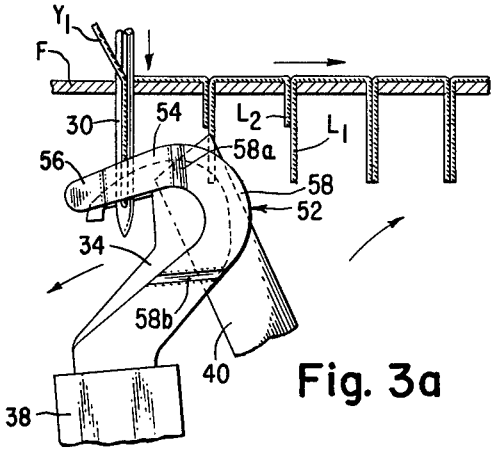
FIGS. 3A–3C are diagrammatic views showing some of the steps of a single cycle of the method of operation of the apparatus of the invention.

Referring now to FIG. 2, as shown therein, a clip member 52, which is formed of relatively thin, resilient material, such as thin metal or the like, is disposed in the same slot 36 as the looper 34 in block 38. The clip member 52 is further disposed in close juxtaposition to the looper 34 with the bill portion 54 of the clip member 52 lying substantially against the comparable bill portion on looper 34. The bill 54 of the clip member 52 extends beyond the end of the bill of the looper 34 as illustrated, and includes a bent end portion 56 which is bent in a direction away from the bill of the looper 34. The purpose of this bent portion 56 will become apparent from the description found hereinafter. The bill 54 of clip member 52 also includes a bent or indented portion 58 toward the rear portion thereof which bent portion 58 is also bent away from the looper 34 so as to provide a cavity or spacing between the bill portion 54 of the clip member 52 and the bill of the looper 34. As illustrated in FIG. 2, the bent portion 58 and the resultant spacing extends between portions 58*a* and 58*b* on the looper. The spacing or cavity formed thereby functions to release lint and loose fibers which can build up between the looper and clip member and effect further efficient operation.

As further illustrated in FIG. 2, it will be seen that the knife 40 is disposed so that it cooperates with the surface of the looper 34 opposite to the surface of said looper which cooperates with the clip member 52.

Referring now to FIGS. *3a–3c*, a partial sequence of operations is illustrated therein and which encompasses substantially a single cycle of one of the tufting mechanisms of a tufting machine of the invention. As the needle 30 begins to descend through the backing fabric with its yarn end $Y_1$, for example, the looper 34 and the clip member 52 are oscillated in a direction toward the needle to intercept the same as it descends. Just prior to the event illustrated in FIG. *3a*, the looper 34 and clip member 52 will have intercepted the needle and the looper 34 will pass on one side of the needle 30 to seize the yarn from the needle 30. The clip member as it approaches the needle 30 will first intercept the needle 30 with its bent end portion 56 which is bent away from the looper 34 and will cause the clip member 52 to be bent away from the needle so that it passes on the other side of the needle from the looper 34. It will thus be seen that the looper 34 and clip member 52 split the needle 34 with each being on an opposite side thereof.

As shown in FIG. *3a*, the needle 30, looper 34, and the clip member 52 are in a position wherein the needle is at substantially the bottom of its stroke and the looper 34 has intercepted the yarn carried by the needle and is disposed on one side of the needle between the needle and the yarn carried by said needle. As mentioned above, the clip member 52 is on the opposite side of the needle. As the needle begins to withdraw or go through its return stroke, which occurs between the time of the illustrations of FIG. *3a* and FIG. *3b*, the looper and clip member will begin to oscillate away from the needle path as indicated by the arrow in FIG. *3b*. At the saame time, the knife 40 will oscillate in a direction towards the needle path to sever the loop of yarn held on the looper bill as illustrated in FIG. *3b*. As further shown in phantom lines in FIG. *3b*, the knife continues so that substantially the entire cutting surface thereof passes through the loop to insure tht it is completely severed. In standard cut pile machines this is not necessary since, if every loop is not completely severed, it may be severed at a later time and does not interfere in any manner in the further operation of the tufting machine. However, in the method of operation of the present invention, it is necessary that the loop be completely severed substantially immediately after its formation in order to carry out the purpose of the invention as will be obvious hereinafter. Thus, the knife 40 is caused to proceed through a substantially longer cutting action than is normally necessary in cut pile machines. After the cutting of the loop, one leg of the loop designated $L_1$ will hang on the far side of the looper (See FIG. *3b*.) while the other leg $L_2$ will be retained between the clip member 52 and the surface of the looper 34 because of the resilient or spring action of the clip member against the looper. Thus, it may be said that the clip member 52 and the looper 34 yieldably restrain one leg of the cut pile loop.

When it is desired to make a J-cut or a cut pile loop having one leg substantially longer than the other, a signal will be fed from the photoelectric pattern mechanism to the pattern attachment 46 to feed a lesser amount of yarn for the next needle stroke than is required to complete the full needle stroke. Since the needle always reciprocates in a constant stroke, yarn will have to be drawn from another source in order for the needle to complete its stroke, or the yarn will be caused to break. Assuming such a signal has been given to the pattern attachment, referring to FIG. *3c*, as the needle descends with a relatively lesser amount of yarn than is required, the needle as it penetrates the backing fabric will begin to draw yarn from the cut pile loop leg $L_2$, which is part of the yarn end carried by the needle, thereby pulling this leg from between the clip member 52 and the looper 34 and shortening leg $L_2$ relative to the leg $L_1$. When the needle completes its downstroke, the cut pile loop will appear substantially as shown in FIG. *3a* wherein the cut pile loops previously formed just prior to the downstroke of the needle has been completed as a J-cut loop. If the pattern attachment is not required to feed a relatively lesser amount of yarn, a full length cut pile loop may be formed such as shown by the first two cut pile loops on the extreme right-hand side of FIG. *3a*. Thus, it may be said that the apparatus of the invention may selectively produce J-cut pile loops or regular or substantially full-length cut pile loops. It should be understood that substantially every cut pile tufting machine inherently produces a very slight J-cut but, for purposes of illustration, the full cut pile loops have been illustrated with equal length legs since the difference is, in all practicality a minimum and is not normally noticeable in the finished product.

It will be seen from the above description that a method and apparatus are provided for producing J-cut pile fabrics wherein the length of the J-cut can be selectively controlled. By using the concept of backrobbing or controlled and selective feed of yarn from the pattern attachment to rob one leg of a cut pile loop, the relative length of the two legs of the cut pile loop can be controlled so that J-cuts of varied relative degrees of length can be provided. As also described above, the apparatus is capable of producing selective J-cut or full cut pile loops.

Further in accordance with the invention, it is possible to produce colored patterned pile fabrics by threading different ones of the needles with different colored yarns and by selectively producing J-cut in one color yarn and full cut pile loops in another color yarn. Since the full cut pile loops of one color will have twice as many long legs as the J-cut loops, the predominance of color in the pattern will be that of the full cut pile loops. Thus, it may be said that there will be twice as much color on the surface due to the full cut pile loops than the color from the J-cut loops. Many relatively intricate patterns can be provided by means of the pattern control mechanism controlling the pattern attachment to selectively produce full cut pile loops or J-cut pile loops in particular areas of the pile surface so that the color appearing on the surface of the pile fabric will be in accordance with the pattern on the pattern mechanism. Thus, it will be apparent that, not only can relatively economical pile fabrics be produced of the cut pile variety, in particular, the shag type or long nap type pile fabrics, through the use of selectively providing controlled length J-cut pile loops, but also the apparatus is capable of producing color patterns through the selective and controlled length of the legs of the cut pile loops.

Figure 4:
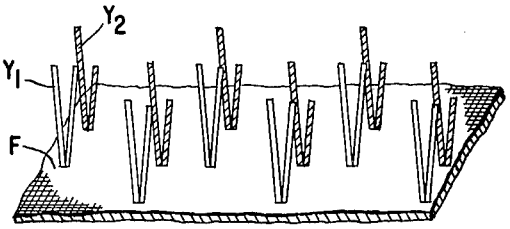
FIG. 4 is an enlarged diagrammatic view of a piece of fabric which may be produced by the present invention.
Figure 3B:
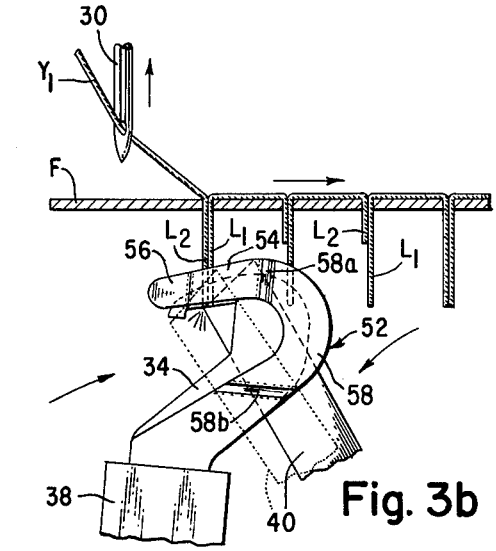

Further variations in patterns may be provided by initiating relative lateral shifting motion between the base fabric F and the needles, the loopers and needle plate. For example, the machine illustrated in FIG. 1 may be provided with a sliding needle plate mechanism wherein the needle plate 32 is capable of lateral shifting motion to initiate lateral shifting motion of the base fabric F. Such a mechanism is known in the art and is disclosed in U.S. Pat. No. 3,301,205. Other mechanisms such as sliding needle bar mechanisms wherein the needles are shifted relative to the base fabric, the needle plate and the loopers, may also be provided. Reference may be made to U.S. Pat. No. 3,026,830. As illustrated in FIG. 4, a relatively exaggerated illustration of a piece of fabric which may be produced by such a mechanism is shown. As shown in FIG. 4, the crosshatched yarn ends are formed as J-cut pile loops and the white or noncrosshatched yarns are formed as full cut pile loops. In the overall pattern on a relatively large sample of the fabric, the white yarns would show up as the dominant color. By virtue of the fact that the rows are formed in a somewhat zig-zag fashion by providing a laterally shifting mechanism of the type hereinbefore described, the pattern may be varied in accordance with the shifting of thedominant and the less dominant colors from row to row.

Figure 5:
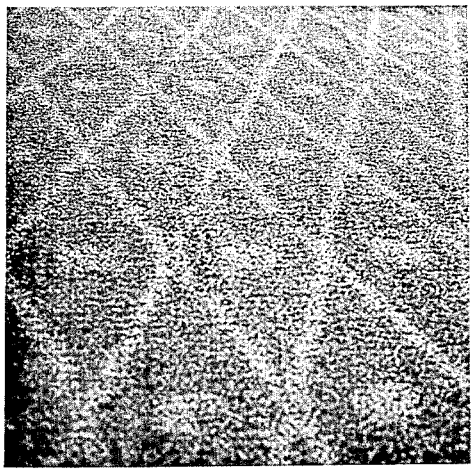
FIG. 5 is a photographic representation of a patterned fabric produced by the apparatus of the invention.
Figure 3C:
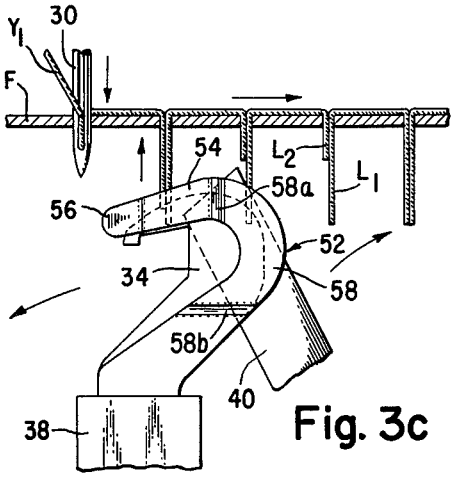

FIG. 5 illustrates a photographic representation of a pattern formed in accordance with the invention. It will be seen from FIG. 5 that the border portion and center circular portion of the diamond pattern is formed with the light-colored yarns as dominant or as having full cut pile loops with J-cut loops intermixed and the dark-colored diamonds are a reverse thereof with the dark-colored yarns having full cut pile loops with the light-colored loops having J-cut pile loops thereby giving the dark color dominance. As described above, by selectively controlling the feed of the yarn and providing the apparatus for forming the J-cut cut pile loops with controlled length and color, many patterns can be produced having a relatively wide variation in shape and color.

Having thus set forth the nature of the invention, what I claim herein is:

1. In an apparatus for producing patterned cut pile fabrics, a yarn carrying needle means supported for endwise movement for penetrating a base fabric to deposit loops of yarn therethrough, looper means for seizing the loop of yarn during the withdrawal of the needle through the base fabric, cutting means cooperating with said looper means for cutting the loop of yarn and operable for cutting the loop substantially immediately after it is seized by said looper, means for selectively backrobbing one leg of the cut loop whereby the cut loop is formed with one relatively long leg and one relatively short leg, and said looper means including a looper member and an oscillating looper support means, said looper member disposed in a slot in said oscillating looper support means, a clip member disposed in the same slot as said looper member, said clip member being resilient and having a bill portion including a retaining portion, and a bent portion disposed away from the free end of the bill, said retaining portion disposed in close juxtaposition with a yarn carrying portion of the looper member for retaining one leg of a cut loop between said clip member and said looper member such that when the loop is cut a leg thereof connected with the needle will be yieldably restrained by said retaining portion of the clip member and said looper member, said bent portion forming a hollow space between said bill portion and said looper member to permit disposal of lint and loose fibers picked up from the yarn.

2. In a tufting apparatus for producing cut pile fabrics having a looper means, said looper means including a looper and a looper support block, said looper having a bill portion and a body portion with said body portion having a portion thereof disposed in a slot in said looper support block, and a clip member having a bill portion disposed substantially in juxtaposition with the looper bill portion for retaining one leg of a cut loop between said clip member and said looper bill and also having a body portion having a portion thereof disposed in the same slot in the looper support block as said looper body portion, said clip member including a bent portion disposted at the rear portion of said bill portion, said bent portion being bent in a direction away from said looper to form a spacing therebetween such that lint and loose fibers may be released from between said clip member and said looper.

* * * * *